US007600847B2

(12) United States Patent
Zhang

(10) Patent No.: US 7,600,847 B2
(45) Date of Patent: Oct. 13, 2009

(54) PRINTING APPARATUS AND METHOD FOR DETERMINING AMOUNT OF PRINTING MATERIAL

(75) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 373 days.

(21) Appl. No.: 11/749,071

(22) Filed: May 15, 2007

(65) Prior Publication Data

US 2007/0263024 A1 Nov. 15, 2007

(30) Foreign Application Priority Data

May 15, 2006 (JP) ..... 2006-134928

(51) Int. Cl.
*B41J 29/393* (2006.01)
*B41J 2/195* (2006.01)
*B41J 2/175* (2006.01)

(52) U.S. Cl. ..... 347/19; 347/7; 347/86

(58) Field of Classification Search ..... 347/19, 347/7, 86

See application file for complete search history.

(56) References Cited

U.S. PATENT DOCUMENTS 6,470,744 B1 * 10/2002 Usui et al. ..... 73/290 R

FOREIGN PATENT DOCUMENTS

JP 2006-088605 4/2006

* cited by examiner

*Primary Examiner*—Julian D Huffman
(74) *Attorney, Agent, or Firm*—Workman Nydegger

(57) ABSTRACT

A printing apparatus and method for detecting the amount of a printing material in a detachable printing material container comprised of a piezoelectric element and a memory in which frequency information is stored. The printing apparatus further comprises an acquiring unit that acquires the frequency information from the memory; a supplying unit that supplies a driving signal to be used for driving the piezoelectric element based on the frequency information of a first driving signal having a first frequency and a second driving signal having a second frequency that is different from the first frequency; a detecting unit that detects a response signal in response to the vibration of the piezoelectric element; a measuring unit that measures vibration frequency contained in the response signal; and a determining unit that determines the amount of the printing material contained in the printing material container based on the measured vibration frequency.

11 Claims, 11 Drawing Sheets

INK-PRESENT STATE

INK-ABSENT STATE

INK-PRESENT STATE

INK-ABSENT STATE

PRINTING APPARATUS AND METHOD FOR DETERMINING AMOUNT OF PRINTING MATERIAL

The entire disclosure of Japanese Patent Application No. 2006-134928, filed May 15, 2006 is expressly incorporated herein by reference.

BACKGROUND OF THE INVENTION

1. Technical Field

The present invention generally relates to a printing apparatus, and more particularly to a method for detecting the amount of a printing material in a printing material container that is mounted to the printing apparatus.

2. Related Art

Currently, some printing material containers which are designed to be mounted on an ink-jet-type printing apparatus are provided with sensors for detecting the amount of remaining printing material. An example of one sensor that is typically used is a piezoelectric element capable of expanding and contracting when a voltage is applied to it. After the voltage is applied, the piezoelectric element generates a residual vibration, and outputs an output signal. Thus, the printing apparatus applies a voltage to the piezoelectric element to measure the vibration frequency of the piezoelectric element contained in the output signal, and determines whether a predetermined amount of the a printing material is in the printing material container.

An example of related art is shown in Japanese Patent JP-A-2003-39707, which discloses a printing apparatus which uses a voltage applied to a piezoelectric element as a sensor. In that apparatus, the amplitude of vibration of the piezoelectric element is increased in order to give more precise measurements of the vibration frequency.

Despite these advances, however, many manufacturing errors arise during the production process of the sensors. Because of these errors, the output signal that is outputted from the sensor can vary from one sensor to another even if the same amount of a printing material remains in a printing material container. Thus, the amplitude of vibration of the piezoelectric element can be small in some cases, making it difficult to measure the vibration frequency of the piezoelectric element precisely and consistently. Consequently, it is often impossible to adequately detect the amount of the printing material contained in the printing material container.

BRIEF SUMMARY OF THE INVENTION

An advantage of some aspects of the invention is a more precise determination of the amount of a printing material contained in a printing material container.

In order to solve at least a part of the problems described above, the present invention provides a printing apparatus that determines the amount of a printing material contained in a printing material container.

One aspect of the invention is a printing apparatus with a detachable printing material container, the printing material container having a piezoelectric element, and a memory unit capable of storing frequency information relating to the natural vibration frequency of the piezoelectric element, the printer comprising: an acquiring section that acquires the frequency information from the memory; a supplying section capable of supplying a driving signal to the piezoelectric element that amplifies the amplitude of the vibration of the piezoelectric element. The drive signal being based on the frequency information of a first driving signal having a first frequency and a second driving signal having a second frequency that is different from the first frequency. The printing apparatus also includes a detecting section capable of detecting a response signal that is outputted in response to vibration of the piezoelectric element, a measuring section capable of measuring the portion of the vibration frequency of the piezoelectric element contained in the response signal; and a determining section capable of determining the amount of the printing material in the printing material container based on the vibration frequency.

Another aspect of the invention is a method for determining the amount of a printing material in the detachably mounted printing material container of a printing apparatus. The printing material container being comprised of a piezoelectric element and a memory unit capable of storing information relating to the natural vibration frequency of the piezoelectric element, and the printing material amount determination method comprising acquiring the frequency information from the memory, supplying a driving signal to the piezoelectric element that amplifies the amplitude of the piezoelectric element, the driving signal being based on a first driving signal having a first frequency and a second driving signal having a second frequency that is different from the first frequency, detecting a response signal of the piezoelectric element after the driving signal is stopped, measuring the vibration frequency portion of the piezoelectric element contained in the response signal, and determining the amount of the printing material contained in the printing material container based on the vibration frequency.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to accompanying drawings, a mode for carrying out the invention is described below while discussing exemplary embodiments.

A. Exemplary Embodiment 1

A1. System Configuration

Figure 1:
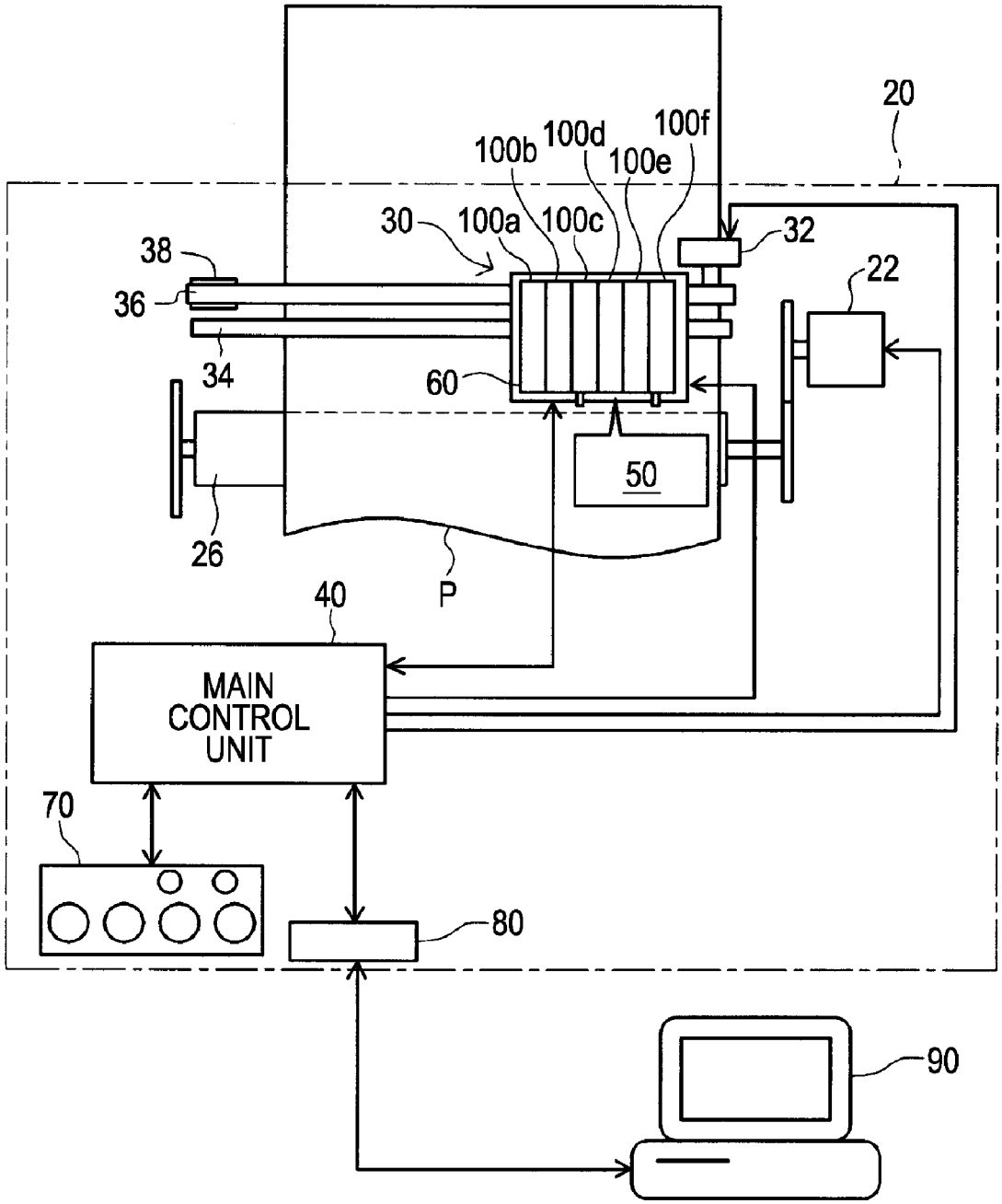
FIG. 1 is an explanatory drawing that schematically illustrates an example configuration of a printing system according to a first embodiment of the invention.

The outline of a printing system configuration according to an exemplary embodiment is explained with reference to FIG. 1. FIG. 1 illustrates the general configuration of a printing system. The printing system comprises a printer 20 and a computer 90. The printer 20 is connected to the computer 90 via a connector 80.

The printer 20 is provided with a sub scan feed mechanism, a main scan feed mechanism, a head control mechanism, and a main controlling unit 40 that controls each mechanism. The sub scan feed mechanism is provided with a paper feed motor 22 and a platen 26. The sub scan feed mechanism transports a paper P in the sub scan direction by initiating the rotational force of the paper feed motor 22. The main scan feed mechanism is provided with a carriage motor 32, a pulley 38, a driving belt 36 which is stretched between the carriage motor 32 and the pulley 38, and a sliding axis 34 which is located in parallel with the axis of the platen 26. The sliding axis 34 supports the carriage 30 that is fixed to the driving belt 36 in a sliding manner. The rotation of the carriage motor 32 is communicated to the carriage 30 via the driving belt 36. The carriage 30 reciprocates in the axial direction (main scan direction) of the platen 26 along the sliding axis 34. The head control mechanism is provided with a print head unit 60 that is mounted on the carriage 30. By driving the print head, the head control mechanism causes ink to be discharged on the paper P. The printer 20 is further provided with a manipulation unit 70 that is used for various printer settings manipulated by a user and for printer status verification.

The print head unit 60 is provided with a print head 69 and a cartridge attachment unit. To the cartridge attachment unit, six ink cartridges 100*a*-100*f* are attached. The print head unit 60 is further provided with a sub control section 50.

Using a plurality of nozzles and a plurality of piezoelectric elements, the print head 69 discharges ink drops from each nozzle to configure dots on the paper P depending on a voltage applied to each piezoelectric element. In the embodiments and the preceding part of description of this specification as well as the recitation of appended claims, a "piezoelectric element" refers to a device having a piezoelectric effect, which may also be defined as a piezoelectric-effect element. In this embodiment, although a "piezo-device" is employed as a specific example of such an element, it is simply referred to as a piezoelectric element without differentiating specific concept from generic one in order to simply explanation.

Each ink cartridge 100*a*-100*f* is provided with a sensor including a piezoelectric element. The printer 20 supplies the piezoelectric element of the sensor with a driving signal. After the supply of the driving signal is stopped, the printer 20 measures the frequency of the residual vibration of the piezoelectric element contained in a response signal in order to determine the amount of ink contained in the ink cartridge. In this exemplary embodiment, hereafter, an ink cartridge is simply referred to as "cartridge".

A2. Printer Circuit Configuration

Figure 2:
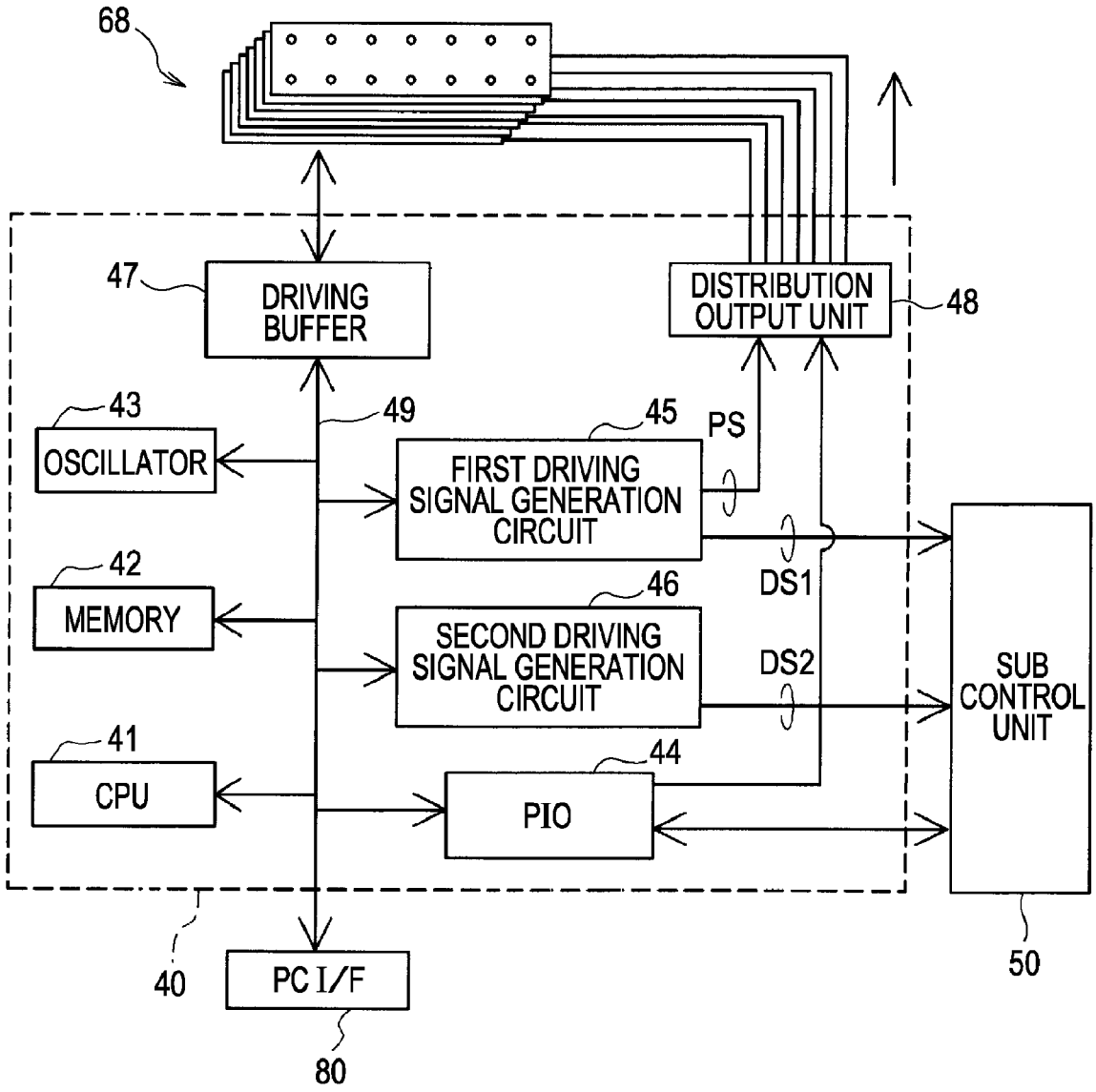
FIG. 2 is an explanatory drawing that schematically illustrates an example electric configuration of a main control unit according to the first embodiment of the invention.
Figure 3:
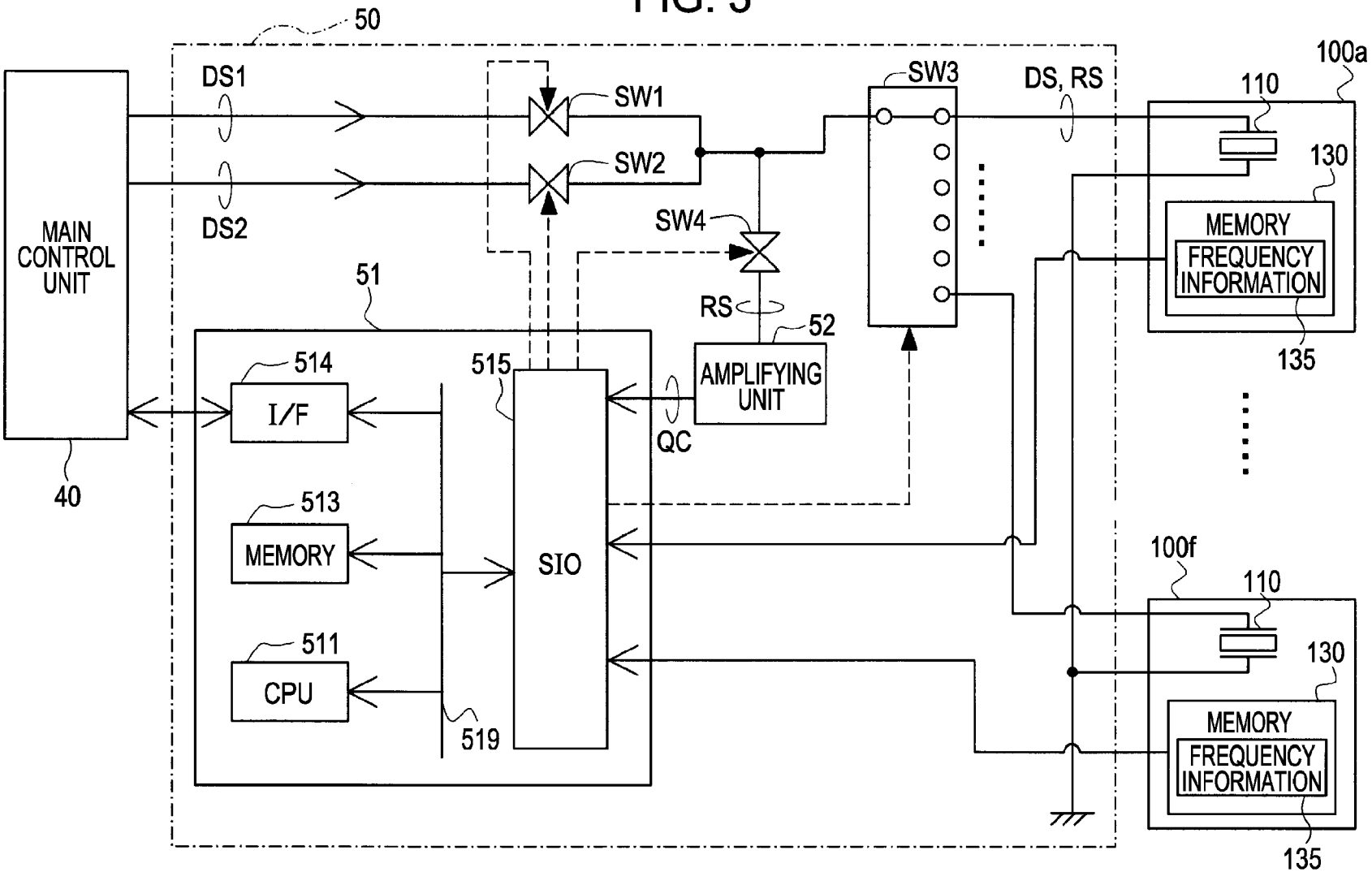
FIG. 3 is an explanatory drawing that schematically illustrates an example electric configuration of a sub control unit and cartridges according to the first embodiment of the invention.

The circuit configuration of the printer 20 is explained with reference to FIG. 2 and FIG. 3. FIG. 2 illustrates the electronic configuration of the main control unit 40 according to the present embodiment of the invention. FIG. 3 illustrates the electric configuration of the sub control unit 50 and the cartridges according to this embodiment of the invention.

The main control unit 40 is provided with a CPU 41, a memory 42, an oscillator 43 that generates a timing signal, a peripheral device input output unit (PIO) 44 that provides/receives a signal to/from a peripheral device, a first driving signal generation circuit 45, a second driving signal generation circuit 46, a driving buffer 47, and a distribution output unit (splitter) 48. These components are interconnected with each other via a bus 49. The bus 49 is also connected to the connector 80, and the main control unit 40 is connected to the computer 90 via the bus 49 and the connector 80. With these connections, it is possible for each of the components described above to provide/receive data to/from the other components.

The driving buffer 47 is used as a buffer to supply a dot ON/OFF signal to the print head 69. The distribution output unit 48 distributes a driving signal that is supplied from the first driving signal generation circuit 45 to the print head 69 at a predetermined timing.

The first driving signal generation circuit 45 generates a head driving signal PS, which is supplied to the print head 69 via the distribution output unit 48 and a first sensor driving signal DS1, which is supplied to the piezoelectric element 112 of each of the cartridges 100*a* 100*f* via the sub control unit 50. In this embodiment, hereafter, a "driving signal" signifies a sensor driving signal. The first driving signal generation circuit 45 supplies the first driving signal DS1 to the sensor 110 via the sub control unit 50.

The second driving signal generation circuit 46 generates a second driving signal DS2, which is supplied to the piezoelectric element 112 on the sensor 110 of each of the cartridges 100*a*-100*f* via the sub control unit 50. The second driving signal generation circuit 46 supplies the second driving signal DS2 to the sensor 110 via the sub control unit 50. The frequency of the second driving signal DS2 is higher than that of the first driving signal.

The sub control unit 50 is a circuit that performs the processing functions which are related to the cartridges 100*a*-100*f* in cooperation with the main control unit 40. FIG. 3 shows the processing functions that are that are necessary for processing of determining the remaining amount of ink in cartridges 100*a*-100*f*. As shown in FIG. 3, the sub control unit 50 is provided with a calculator 51, four switches SW1-SW4, and an amplifying unit 52.

The calculator 51 is provided with a CPU 511, a memory unit 513, an interface 514, and an input/output unit (SIO) 515, which functions to provide/receive a signal to/from the components inside the sub control unit 50 and to/from the cartridges 100*a*-100*f*. Each of the aforementioned components of the main control unit 40 is connected thereto via the bus 519. The calculator 51 provides/receives a signal to/from the main control unit 40 via the interface 514. The calculator 51 controls the four switches SW1-SW4 via the SIO 515. In addition, the calculator 51 receives output from the amplifying unit 52 via the SIO 515.

The first switch SW1 is a 1-channel analog switch. One terminal of the first switch SW1 is connected to the first driving signal generation circuit 45 of the main control unit 40, whereas the other terminal thereof is connected to the third switch SW3 and the fourth switch SW4. The first switch SW1 is set in an ON state when the first driving signal DS1 is supplied to the sensor 110, whereas it is set in an OFF state when the second driving signal DS2 is supplied to the sensor 110 and when a response signal RS from the sensor 110 is detected.

The second switch SW2 is another 1-channel analog switch. One terminal of the second switch SW2 is connected to the second driving signal generation circuit 46 of the main control unit 40, whereas the other terminal thereof is connected to the third switch SW3 and the fourth switch SW4. The second switch SW2 is set in an ON state when the second driving signal DS2 is supplied to the sensor 110, whereas it is set in an OFF state when the first driving signal DS1 is supplied to the sensor 110 and when a response signal RS from the sensor 110 is detected.

The third switch SW3 is a 6-channel analog switch. The terminals on one side of the third switch SW3 are connected to the first switch SW1, the second switch SW2, and the fourth switch SW4, whereas each of six terminals at the other side are connected to an electrode of the corresponding sensor 110 for each of the corresponding six cartridges 100*a*-100*f*. It should be noted that the other electrode of each sensor 110 is grounded. By switching the third switch SW3 over in a sequential manner, either one of the six cartridges 100*a*-100*f* may be selected sequentially.

The fourth switch SW4 is a 1-channel analog switch. One terminal of the fourth switch SW4 is connected the first switch SW1, the second switch SW2, and the third switch SW3, whereas the other terminal is connected to the amplifying unit 52. The fourth switch SW4 is set in an OFF state when the first driving signal DS1 or the second driving signal DS2 is supplied to the sensor 110, and is set in an ON state when a response signal RS from the sensor 110 is detected.

The amplifying unit 52, which includes an operational amplifier, compares the response signal RS with a reference voltage Vref, functioning as a comparator. The amplifying unit 52 outputs a HIGH signal when the voltage of the response signal RS is equal to or greater than the reference voltage Vref whereas it outputs a LOW signal when the voltage of the response signal RS is less than the reference voltage Vref. The output signal QC coming from the amplifying unit 52 takes the form of a digital signal that consists of either HIGH signal or a LOW signal.

During the frequency measurement process, the CPU 41 counts the output signal QC that is outputted from the amplifying unit 52, measuring the vibration frequency of the piezoelectric element 112, and then determining the amount of ink contained in the ink cartridge. By this method, the CPU 41 can display the determination result of the amount of ink on the display screen of the computer 90, notifying user of the result. This determination process will be explained more fully below.

A3. Detailed Configuration of Ink Cartridge and Sensor

Figure 4B:
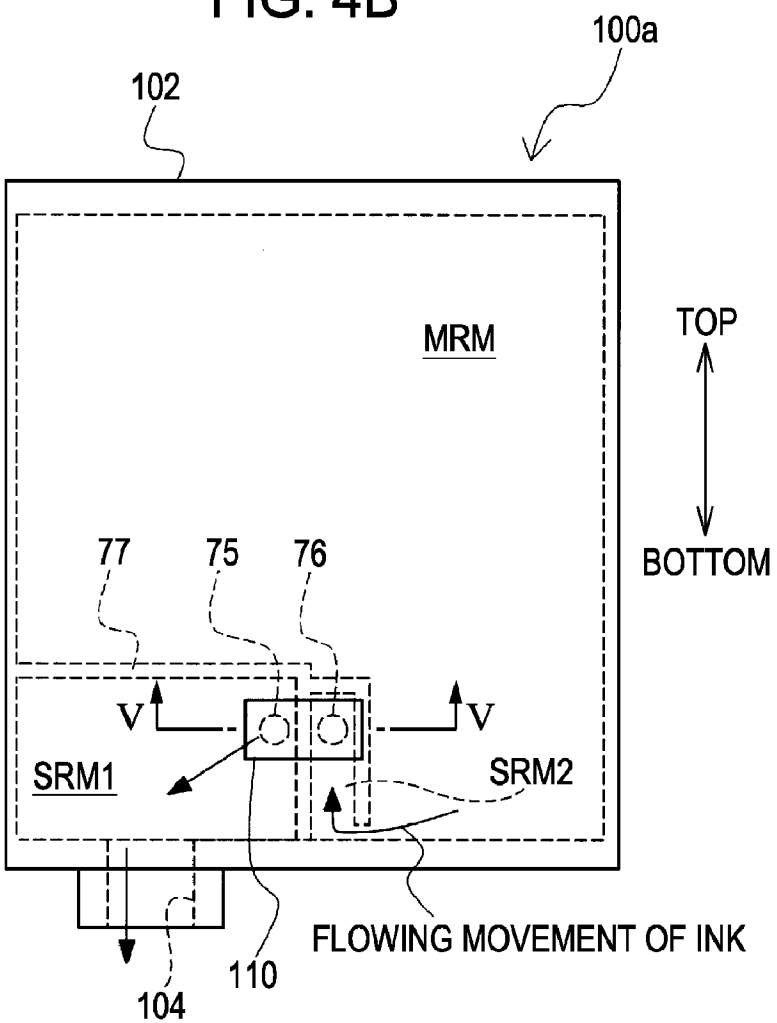
FIGS. 4A and 4B are a set of schematic diagrams that exemplify an example configuration of an ink cartridge according to the first embodiment of the invention.
Figure 4A:
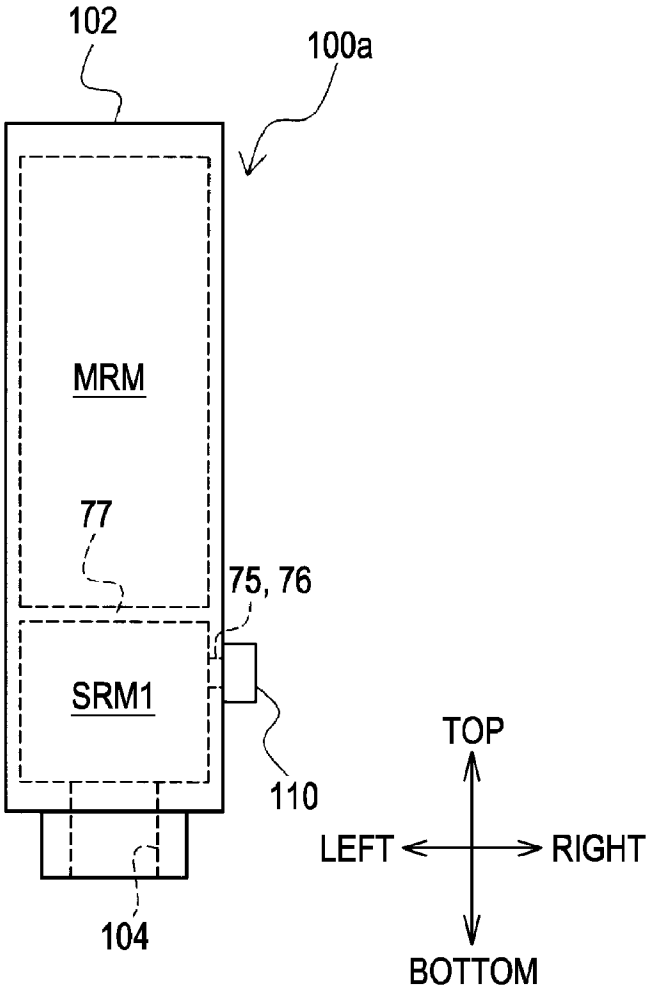

The detailed configuration of the ink cartridge and the sensor is explained with reference to FIG. 4 and FIG. 5. FIG. 4 include a front view (FIG. 4A) and a side view (FIG. 4B) that illustrate an exemplary configuration of an ink cartridge. FIG. 5A and FIG. 5B are sectional views of the peripheral part of the sensor provided in the ink cartridge.

As illustrated in FIG. 4A and FIG. 4B, the body 102 of the cartridge 100*a* has a plurality of portions containing ink. A main container portion MRM occupies the majority of the entire volume of the portions. A first sub container portion SRM 1 is capable of communicating with an ink supply port 104 at the bottom surface of the cartridge 100*a*. A second sub container portion SRM2 is capable of communicating with the main container portion MRM near the bottom surface.

Figure 5A:
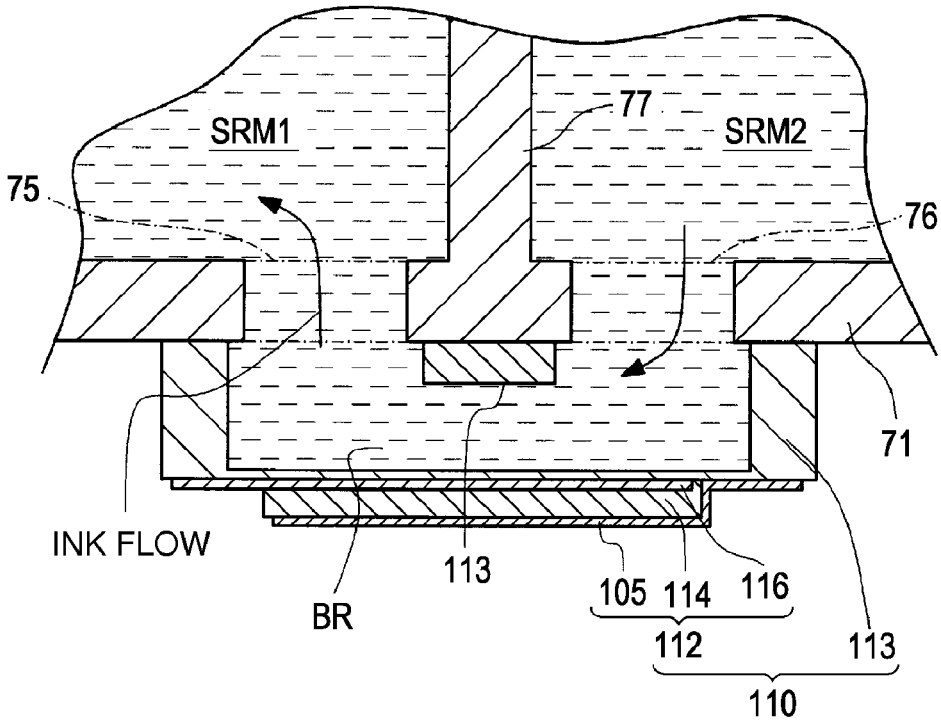
FIGS. 5A and 5B are a set of schematic diagrams that exemplify the sensor peripheral part according to the first embodiment of the invention.
Figure 5B:
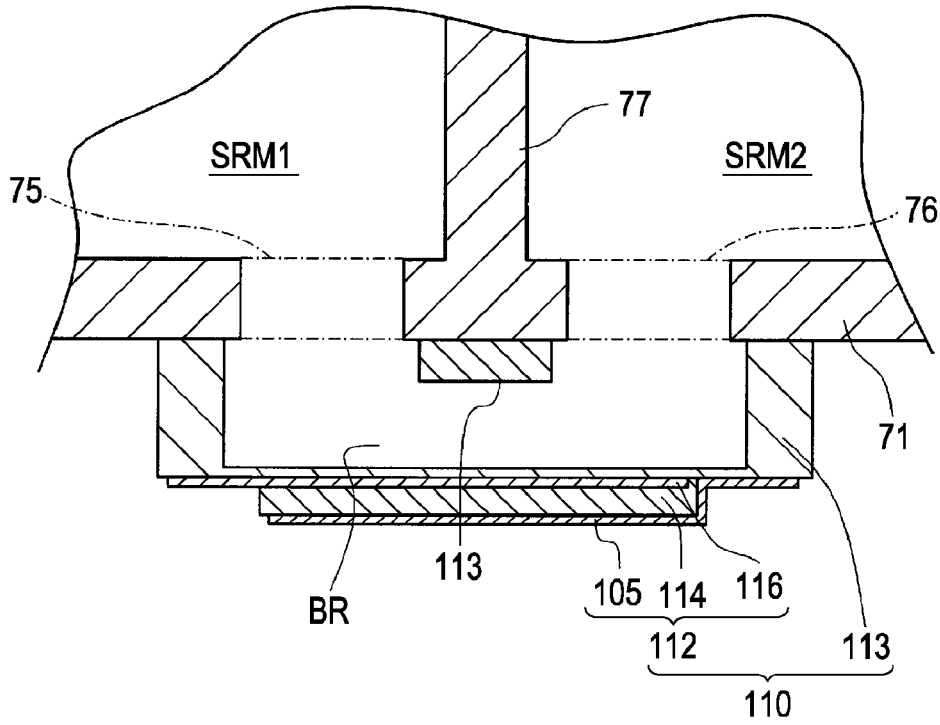

FIG. 5A and FIG. 5B illustrate a peripheral cross section of the sensor cut along line A-A of FIG. 4B, where the cross section is viewed from the top. As illustrated in FIG. 5A and FIG. 5B, the sensor 110 is provided with the piezoelectric element 112 and a sensor attachment 113. The piezoelectric element 112 is located on the sensor attachment 113, the piezoelectric element 112 having a piezoelectric unit 114 as well as two electrodes 115 and 116 on either side of the piezoelectric unit 114. The piezoelectric unit 114 is formed of ferroelectric such as Pb $(Zr_xTi_{1-x})0_3$ (PZT). In the sensor attachment 113, a bridge fluid channel BR is formed, roughly in a letter "U" shape. The part of the sensor attachment 113 between the bridge fluid channel BR and the piezoelectric element 112 is shaped into a thin film. With this configuration, the peripheral part of the piezoelectric element 112 and the bridge fluid channel BR vibrate together.

The ink contained in the cartridge 100*a* flows as illustrated by solid arrows in FIG. 4A, FIG. 4B, FIG. 5A, and FIG. 5B. More specifically, the ink contained in the main container room MRM flows into the second sub container room SRM 2 through the neighborhood of the bottom surface. The ink that has flowed into the second sub container room SRM 2 passes through a second side surface hole 76, the bridge fluid channel BR in the sensor attachment 113, a first side surface hole 75, and then flows into the first sub container room SRM 1. Finally, the ink that has flowed into the first sub container room SRM 1 passes through the ink supply port 104 to be supplied to the print head unit 60.

FIG. 5A illustrates a state in which, a predetermined amount, or greater, of ink is present In the cartridge 100*a* (in this embodiment, hereafter, such a state is referred to as "ink-present state"). As illustrated in FIG. 5A, the ink-present state indicates a state in which ink is filled inside the bridge fluid channel BR formed in the sensor attachment 113, which constitutes a part of the sensor 110. In other words, the ink-present state signifies a state in which some ink is present at the position where the sensor 110 is provided in the cartridge 100*a* (i.e. ink detection position) and which the ink is in contact with the thin film portion of the sensor attachment 113, where the film portion is sandwiched between the bridge fluid channel BR and the piezoelectric element 112.

On the other hand, FIG. 5B illustrates a state in which the amount of ink that is present in the cartridge 100*a* is less than a predetermined amount (in this embodiment, hereafter, such a state is referred to as "ink-absent state"). The ink-absent state indicates a state in which ink is not filled inside the bridge fluid channel BR. In other words, the ink-absent state signifies a state In which no ink is present at the ink detection position and which no ink is In contact with the ink detection area.

A4. Driving Signal

A driving signal for improving the precision in detecting the vibration frequency will now be more fully explained. As described above, the printer 20 supplies a driving signal to a piezoelectric element in the cartridge. The printer 20 also measures the frequency of a response signal outputted from the piezoelectric element in order to determine the amount of ink contained in the cartridge. During this process, it is desirable to make the amplitude of a response signal larger than normal in order to improve the precision of the detection of the vibration frequency. Therefore, it is preferable that the frequency of a driving signal is matched with the natural vibration frequency (eigenfrequency) of the piezoelectric signal 112, because a piezoelectric element resonates at a relatively larger amplitude when a driving signal having the same frequency as that of the natural vibration frequency of the piezoelectric element is supplied to the piezoelectric element.

However, during the manufacturing process of a cartridge sensor, errors often occur. These manufacturing errors mean that the natural vibration frequency of a cartridge is within a margin of error with respect to the target natural vibration frequency H1 in an ink-present state and the target natural vibration frequency H2 in an ink-absent state. This margin of error is explained with reference to FIG. 6. FIG. 6 is an explanatory set of drawings that exemplify the error range of the natural vibration frequency of a cartridge according to the embodiment of the invention. 6A indicates the error range of the natural vibration frequency of a piezoelectric element in a state when ink is present, while FIG. 6B indicates the error range of the natural vibration frequency of the piezoelectric element in ink is not present (absent).

Figure 6A:
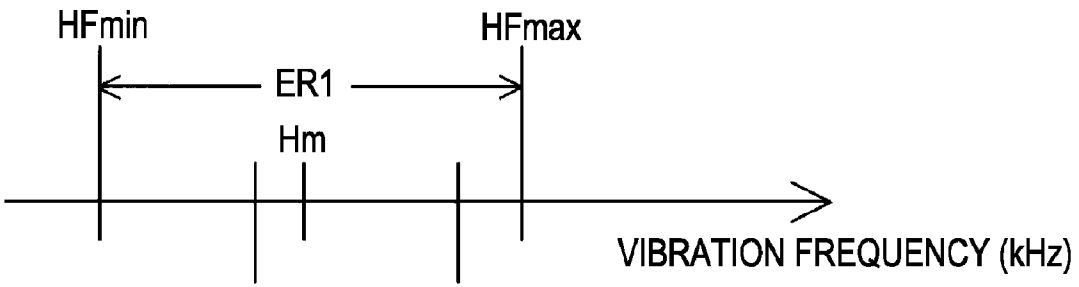
FIGS. 6A and 6B are an explanatory set of drawings that exemplify the error range of the natural vibration frequency of a cartridge according to the first embodiment of the invention.
Figure 6B:
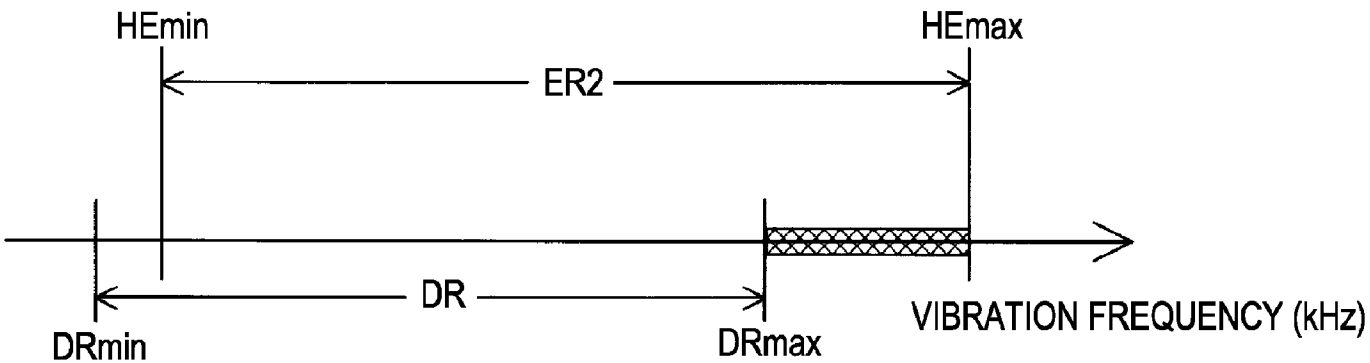

As illustrated in FIG. 6A, the error range ER1 of the natural vibration frequency fF of a piezoelectric element in an ink-present state is denoted as "from HFmin (kHz) to HFmax (kHz)". Similarly, as illustrated in FIG. 6B, the error range ER2 of the natural vibration frequency fE of the piezoelectric element in an ink-absent state is denoted as "from HEmin (kHz) to HEmax (kHz)".

In the state when the cartridge has no ink, the frequency of a response signal is set as the frequency of a driving signal as explained below. When a driving signal having a frequency with the same value as the middle vibration frequency Hm is supplied to the piezoelectric element, a satisfactorily precise result is expected if the natural vibration frequency fE of the piezoelectric element of the target cartridge in an ink-absent state falls within the range specified by the following mathematical equation, referred to as detectable range DR.

$$(\text{Driving Signal Frequency } F^{*}3)-\alpha\,\% \leqq \text{Natural Vibration Frequency } fE \leqq (\text{Driving Signal Frequency } F^{*}3)+\alpha\,\%$$

The numerical value $\alpha$ In the Mathematical Expression 1 denotes an error tolerance factor that is calculated based on a production test conducted during a production process, where the value thereof in this embodiment is $\alpha=8$. That is, if the natural vibration frequency fE of the target cartridge falls within the detectable range DR (from DRmin (kHz) to DRmax (kHz)), the residual vibration of the piezoelectric element is excited effectively so as to amplify the amplitude of a response signal. However, when the natural vibration frequency fE of the target cartridge is higher than DRmax (i.e. when it falls within the hatched area in FIG. 6B), the natural vibration frequency fE does not fall within the detectable range DR; and therefore, the residual vibration of the piezoelectric element is not effectively excited, resulting in a decreased detection precision.

In addition to the process described above, in order to match the frequency of a driving signal with the natural vibration frequency of the piezoelectric element of the target cartridge, it is necessary to generate a driving signal having a different frequency from others for each target cartridge each time the ink determination process occurs, which requires a relatively longer processing time.

As such, a printer according to the embodiment of the invention comprises two circuits that generate two types of driving signals, one of which has a frequency different from the frequency of the other, that is, a first driving signal generation circuit 45 and a second driving signal generation circuit 46, so that the two types of the driving signals are outputted concurrently. Additionally, the printer may switch between the first switch SW1 and the second switch SW2 so as to supply either driving signal, driving signal DS1 or driving signal DS2, whichever has the frequency closer to the natural vibration frequency of the piezoelectric element. Using this method, it is possibly to supply a driving signal to the piezoelectric element that causes an increased residual vibration without requiring the selection and generation of a driving signal for each target cartridge. As a result, it is possible to improve the detection precision of a response signal, which contributes to a more precise determination of the ink amount.

In this embodiment, an frequency that falls within the error range ERI and is lower than the middle vibration frequency Hm (kHz) of the error range ER1 is adopted as the frequency of the first driving signal DS1, denoted as F1, whereas another frequency that falls within the error range ER1 that is higher than the middle vibration frequency Hm (kHz) of the error range ER1 is adopted as the frequency of the second driving signal DS2, denoted as F2.

Figure 7A:
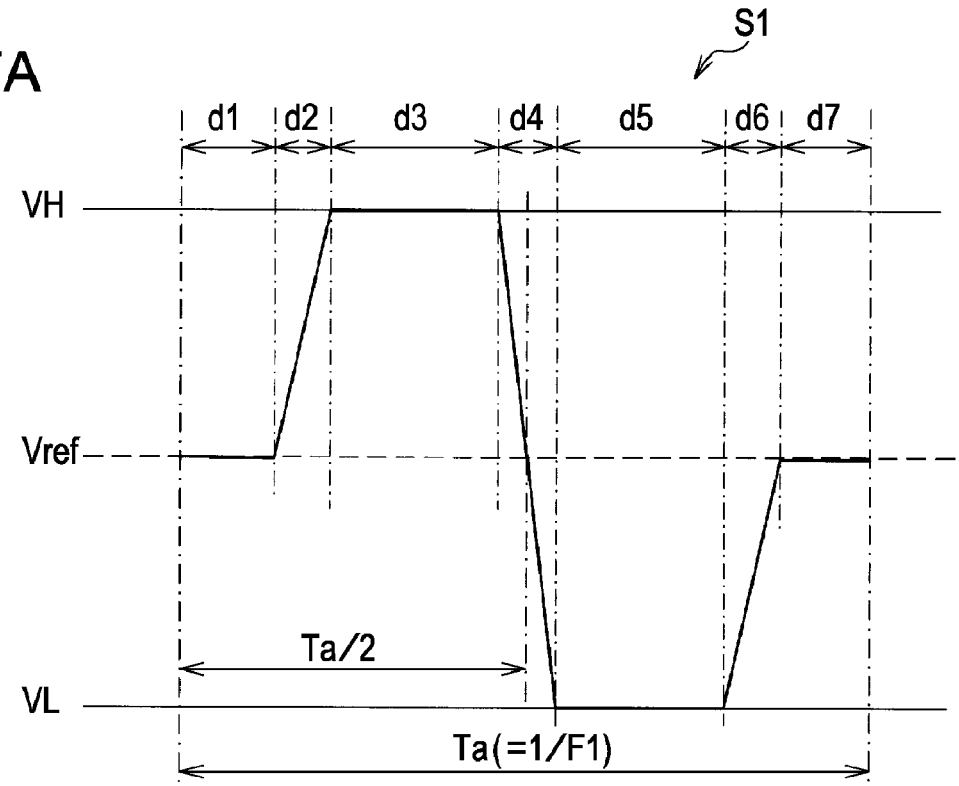
FIGS. 7A and 7B are an explanatory set of drawings that exemplify a driving signal according to the first embodiment of the invention.
Figure 7B:
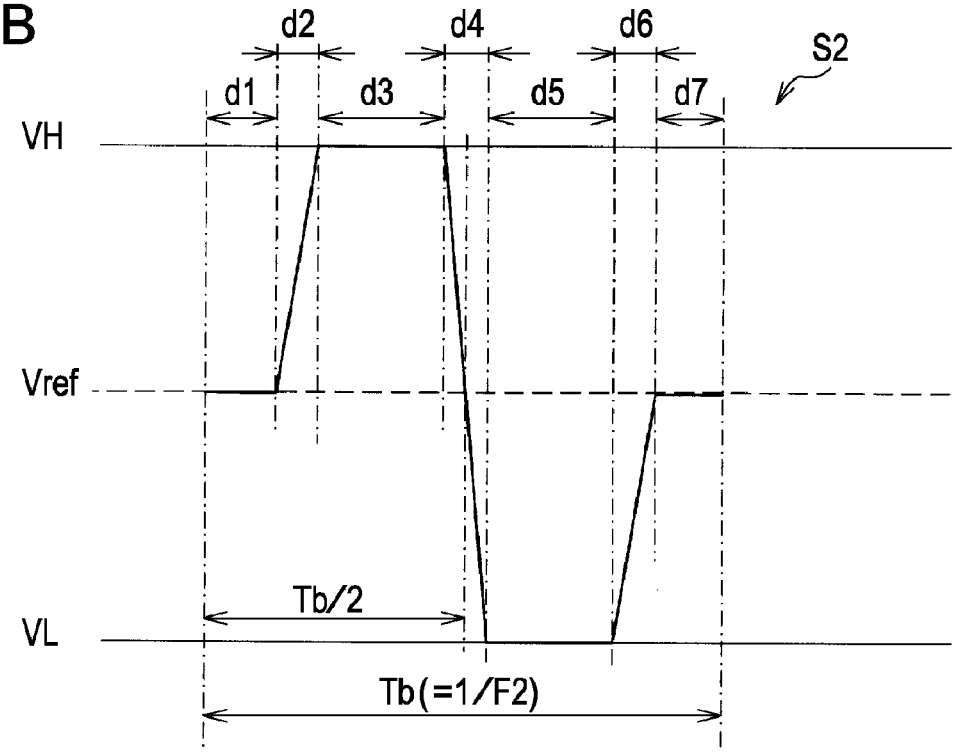

A driving signal that is generated by the first driving signal generation circuit 45 and another driving signal that is generated by the second driving signal generation circuit 46 are explained with reference to FIG. 7A and FIG. 7B, respectively. FIG. 7A is a waveform diagram that exemplifies the pulse shape of the first driving signal DS1. FIG. 7B is a waveform diagram that exemplifies the pulse shape of the second driving signal DS2. In the following description, a partial pulse waveform S1 shown in FIG. 7A is included as an example of a driving signal. The CPU 41 acquires a driving signal generation parameter, which is stored in the memory unit 42. The memory unit 42 stores a first parameter for generating the first driving signal DS1 and a second parameter for generating the second driving signal DS2. In order to generate the first driving signal DS1, the CPU 41 acquires the first parameter from the memory 42, and then calculates an output voltage for each update cycle $\tau$ based on the first parameter. The update cycle $\tau$ ranges, for example, from 0.1 μs (clock frequency=10 MHz) to 0.05 kHz (clock frequency=20 kHz). The driving signal generation parameter contains, a driving voltage Vh, a ratio specifying the relation between the driving voltage Vh and the reference voltage Vref, a duration of time d1 during which the reference voltage Vref is kept, a duration of time d2 during which the voltage is raised from the reference voltage Vref to the maximum voltage VH at a certain inclination, a duration of time d3 during which the maximum voltage VH is kept, a duration of time d4 during which the voltage is lowered from the maximum voltage VH to the minimum voltage VL at a certain inclination, a duration of time d5 during which the minimum voltage VL is kept, a duration of time d6 during which the voltage is raised from the minimum voltage VL to the reference voltage Vref at a certain inclination, a duration of time d7 during which the reference voltage Vref is kept, and cycle T (=1/driving signal frequency F).

In this embodiment, the reference voltage Vref is set at 50% of the driving voltage Vh; and therefore, the value of "0.5" is stored in the memory 42 as the ratio specifying the relation between the driving voltage Vh and the reference voltage Vref.

Next, the CPU 41 calculates the reference voltage Vref, the maximum voltage VH, and the minimum voltage VL based on the first parameter. Using the durations of time d1-d7 described above, the CPU 41 calculates the output voltage for each update cycle 1. Then, the CPU 41 calculates a DAC value for each update cycle $\tau$ based on the calculated output voltage for each update cycle $\tau$.

The CPU 41 gives instructions on a voltage that should be outputted by using the first parameter and the calculated DAC value to the first driving signal generation circuit 45. In response to the instructions given from the CPU 41, the first driving signal generation circuit 45 outputs the first driving signal DS1 shown in FIG. 7A.

In the same manner, the CPU 41 calculates a DAC value for each update cycle τ based on the second parameter, and gives instructions on a voltage that should be outputted by using the second parameter and the calculated DAC value to the second driving signal generation circuit 46. In response to the instructions given from the CPU 41, the second driving signal generation circuit 46 outputs the second driving signal DS2 shown in FIG. 7B.

As explained above, the first driving signal generation circuit 45 generates the first driving signal DS1 illustrated in FIG. 7A, while the second driving signal generation circuit 46 generates the second driving signal DS2 illustrated in FIG. 7B. The CPU 41 controls the first driving signal generation circuit 45 and the second driving signal generation circuit 46 so that the first driving signal DS1 and the second driving signal DS2 may be outputted concurrently.

A5. Selection of Driving Signal

The driving signal selection process comprises the selection of either the first driving signal DS1 or the second driving signal DS2 as the driving signal that should be supplied to the piezoelectric element, and is explained below. The CPU 41 performs the driving signal selection processing. As described above, the error range ER1 of the natural vibration frequency fF in an ink-present state is denoted as "from HFmin (kHz) to HFmax (kHz)", whereas the error range ER2 of the natural vibration frequency fE in an ink-absent state is denoted as "from HEmin (kHz) to HEmax (kHz)"; herein, the natural vibration frequency fF is calculated from the error range ER1, the error range ER2, and the natural vibration frequency fE in accordance with the mathematical equation (2) listed below:

$$fF=(fE-HE\mathrm{min})*(HF\mathrm{max}-HF\mathrm{min})/(HE\mathrm{max}-HE\mathrm{min})+HF\mathrm{min}$$

In a memory 130, the natural vibration frequency fE of a piezoelectric element in an ink-absent state, which was measured in a production test, is stored in advance as frequency information 135. The CPU 41 acquires the natural vibration frequency fE from the memory 130 of the target cartridge via the sub control unit 50 and calculates the natural vibration frequency fF using mathematical equation (2). The CPU 41 then selects the first driving signal DS1 as a driving signal when the calculated natural vibration frequency fF is lower than the middle vibration frequency Hm, whereas it selects the second driving signal DS2 as a driving signal when the calculated natural vibration frequency fF is higher than the middle vibration frequency Hm. Here, the CPU 41 selects the second driving signal DS2 as a driving signal, and then notifies the result of selection to the calculator 51.

In accordance with the result of selection, the calculator 51 controls the connection of the first switch SW1 and the second switch SW2. For example, when the CPU 41 indicates the use of the second driving signal, the calculator 51 sets the first switch SW1 into a disconnection state, whereas it sets the second switch SW2 into a connection state. By this means, it is possible to supply only the second driving signal DS2 to the piezoelectric element.

A6. Ink Amount Determination Process

Figure 8:
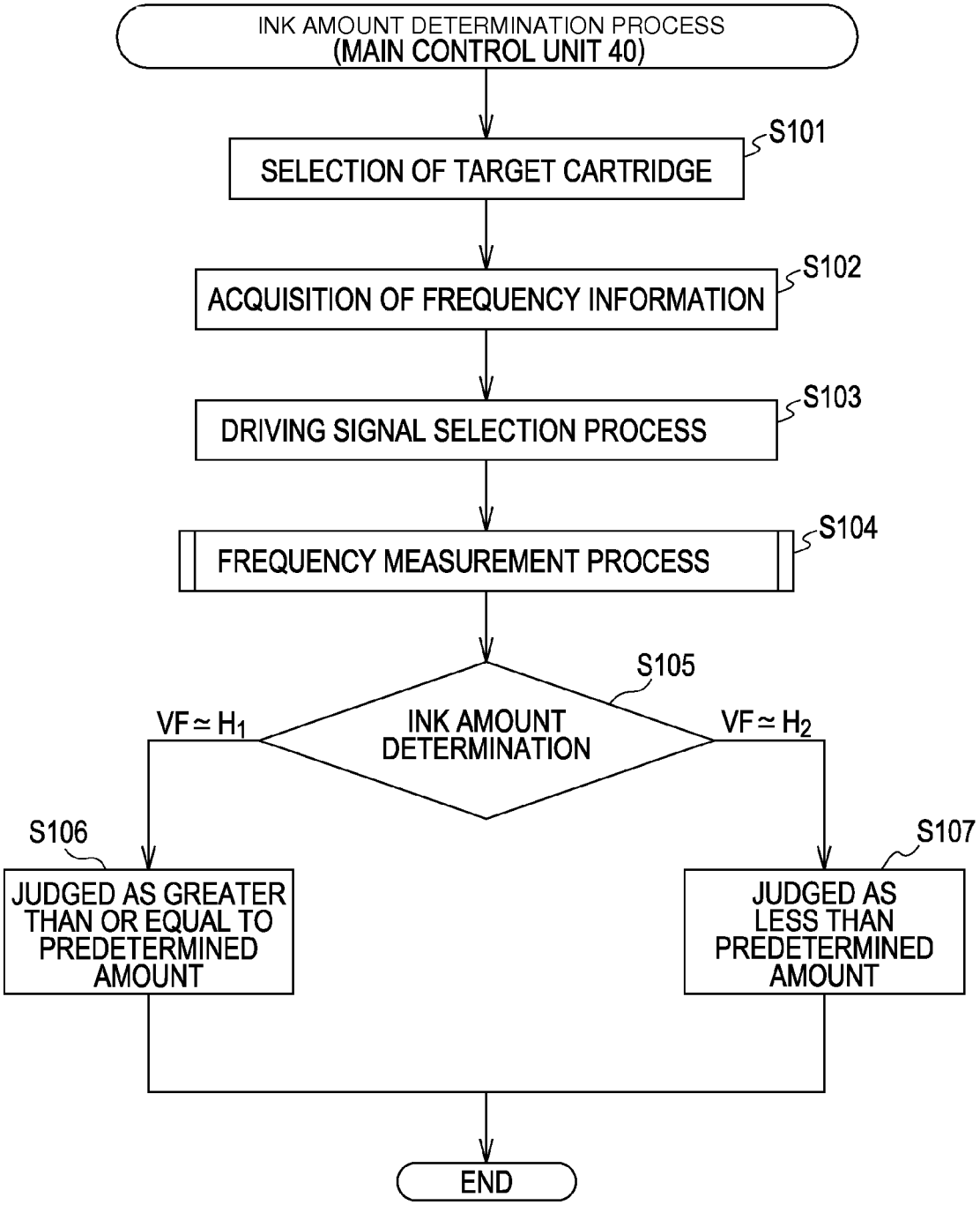
FIG. 8 is a flowchart illustrating an ink amount determination processing according to the first embodiment of the invention.
Figure 9:
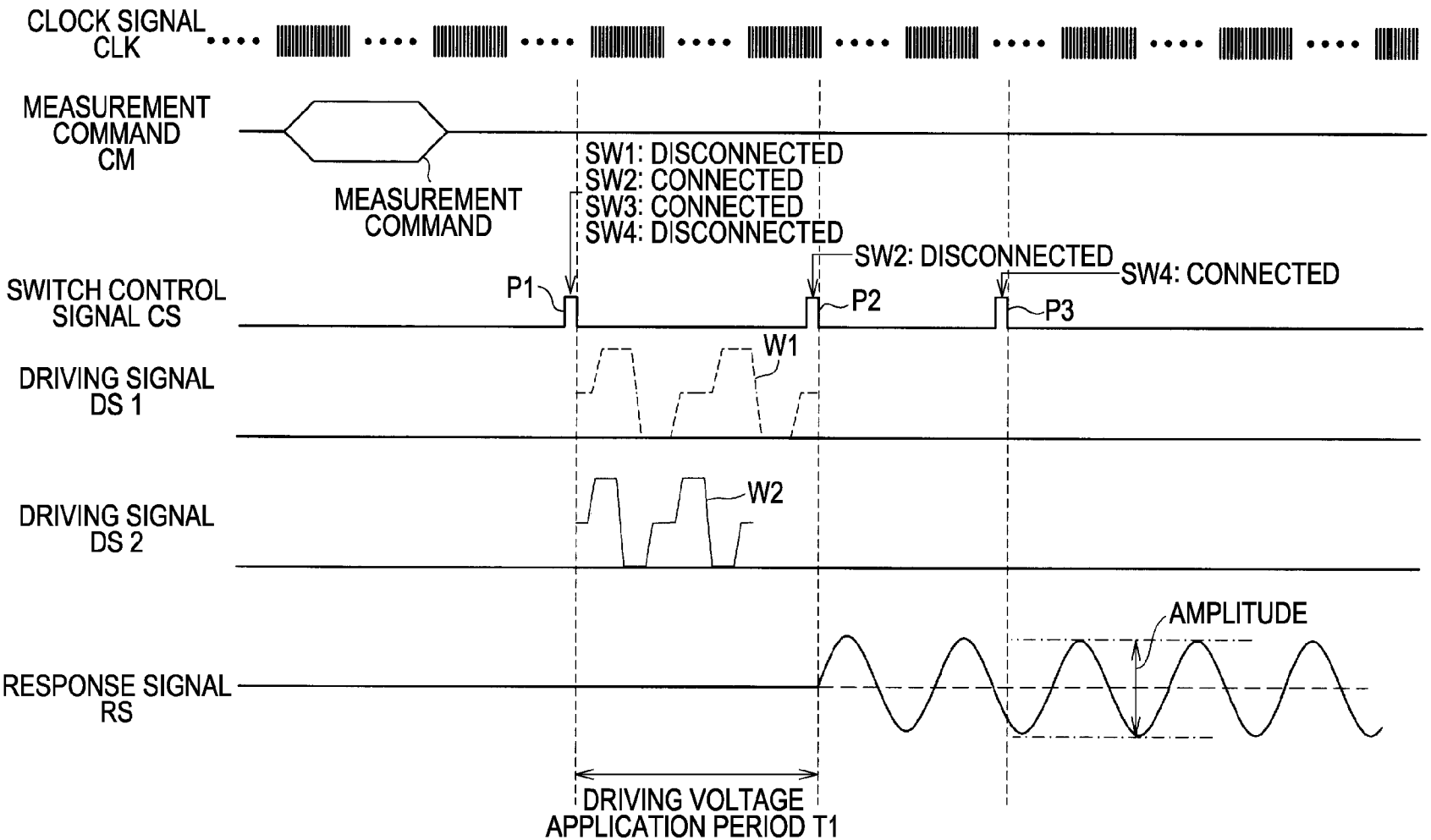
FIG. 9 is a timing chart illustrating a process of measuring the frequency according to the first embodiment of the invention.

The ink amount determination process is explained with reference to FIG. 8 and FIG. 9. FIG. 8 is a flowchart for explaining ink amount determination processing according to this embodiment of the invention. FIG. 9 is a timing chart for explaining frequency measurement process according an embodiment of the invention.

The ink amount determination process is the determination of amount of ink contained in a cartridge, where such a determination is conducted for each cartridge 32 so as to judge whether the amount of contained ink is greater than, or at least equal to, a predetermined amount or less than the predetermined amount. Typically, the ink amount determination processing is executed at the time of power activation of the printer 20.

Upon starting the ink amount determination process, the CPU 41 of the main control unit 40 selects a target cartridge from among the six cartridges 100*a*-100*f* (step S101).

The main control unit 40 acquires the frequency information 135 from the memory 130 provided in the target cartridge (step S102). More specifically, the main control unit 40 transmits, to the calculator 51 of the sub control unit 50, a command that dictates the sub control unit 50 to acquire the frequency information 135 that is stored in the memory 130 of the target cartridge. Then the CPU 511 of the calculator 51 acquires the frequency information 135 to send to the sub control unit 50.

Based on the frequency information 135, the main control unit 40 performs a driving signal selection process during which either the first driving signal or the second driving signal is selected as a driving signal sent to the piezoelectric element using the process described above (step S103) In this example, it is assumed that the second driving signal is selected using the driving signal selection process.

The main control unit 40 generates a driving signal and outputs it to the piezoelectric element and then performs frequency measurement processing (step S105). In this operation, the CPU 41 of the main control unit 40 controls the first driving signal generation circuit 45 and the second driving signal generation circuit 46 so that the first driving signal and the second driving signal are outputted concurrently. The frequency measurement process is explained with reference to the timing chart illustrated in FIG. 9. In the frequency measurement process, a clock signal CLK, a measurement command CM, and a switch control signal SS shown in FIG. 9 are signals that are transmitted from the PIO 45 of the main control unit 40 to the calculator 51 of the sub control unit 50. In addition to a command instruction dictating the execution of the frequency measurement process, the measurement CAM contains information designating a target cartridge. As previously described, the first driving signal DS1 is a signal which is outputted from the first driving signal generation circuit 45 of the main control unit 40 to the piezoelectric element 112 of the target cartridge via the sub control unit 50. On the other hand, the second driving signal DS2 is a signal that is outputted from the second driving signal generation circuit 46 of the main control unit 40 to the piezoelectric element 112 of the target cartridge via the sub control unit 50. The response signal RS is a signal that is generated in response to the residual vibration of the piezoelectric element after the driving signal DS is supplied.

At the timing of receiving a first pulse PI of the switch control signal SS, the calculator 51 of the sub control unit 50 controls the third switch SW3 in accordance with the measurement command CM, which has been previously received, and puts the piezoelectric element 112 of the target cartridge into a connection state with the sub control unit 50. Moreover, the calculator 51 sets either one of the first switch SWI and the second switch SW2 into a connection state and the other into a disconnection state at the in order to selectively supply only the driving signal that was selected through the driving signal selection process to the piezoelectric element. In this embodiment of the invention, because it is assumed that the second driving signal is being selected, the second switch SW2, which is connected to the second driving signal generation circuit 46 for outputting the second driving signal is set into a connected state, whereas the first switch SW1, which is connected to the first driving signal generation circuit 45 for outputting the first driving signal is set into a disconnected state. By this method, it is possible to electrically disconnect the first driving signal generation circuit 45 from the piezoelectric element 112 of the target cartridge and to electrically connect the second driving signal generation circuit 46 with the piezoelectric element 112 of the target cartridge, thereby making it possible to apply the only selected second driving signal DS2 to the piezoelectric element 112. For example, when the first driving signal DSI has been selected during the driving signal selection process, the first switch SWI is been set in a connected state while the second switch SW2 has been set in a disconnected state at the time of the first pulse P1, and the first switch SWI is then set into a disconnected state at the timing of receiving the second pulse P2. In addition, the calculator 51 puts the third switch SW3 into a disconnected state. With this setting, the amplifying unit 52 is electrically disconnected from the first driving signal generation circuit 45, the second driving signal generation circuit 46, and the piezoelectric element 112, which prevents the first driving signal DS1 and the second driving signal DS2 from being applied to the amplifying unit 52.

As illustrated in FIG. 9, the first driving signal DS1 (waveform pulse W1) and the second driving signal DS2 (waveform pulse W2) are outputted from the first driving signal generation circuit 45 and the second driving signal generation circuit 46 respectively on a concurrent basis. In this embodiment of the invention, it is assumed that the second driving signal DS2 has been selected through the driving signal selection processing as a driving signal that should be supplied to the piezoelectric element, and prior to the outputting of the drive signal, the first switch SW1 has been set into a disconnection state while the second switch SW2 has been set into a connection state; and therefore, out of the outputted first driving signal and the outputted second driving signal, the second driving signal DS2 only is applied to the piezoelectric element of the target cartridge. At the time of completion of driving signal application, the main control unit 40 causes the second pulse P2 to be generated in the switch control signal SS. The calculator 51 of the sub control unit 50 puts the second switch SW2 into a disconnected state when it receives the second pulse P2 of the switch control signal SS. For example, when the first driving signal DS1 has been selected in the driving signal selection process, because the first switch SW1 has been set in a connection state while the second switch SW2 has been set in a disconnected state, the first switch SW1 is then set into a disconnected state upon receiving the second pulse P2. The duration of time from the setting of the first switch SWI or the second switch SW2 into a connected state to the setting of the first switch SW1 or the second switch SW2 into a disconnected state is referred to as a driving voltage application period T1.

After the driving voltage application period T1 has elapsed, the piezoelectric element 112 that has been excited by the driving signal outputs a response signal RS in accordance to the distortion due to the vibration. After generation of the second pulse P2, the main control unit 40 generates the third pulse P3 in the switch control signal SS. The calculator 51 of the sub control unit 50 puts the fourth switch SW4 into a connection state at the timing of receiving the third pulse P3 of the switch control signal SS. As this result, the response signal RS coming from the piezoelectric element 112 is inputted into the amplifying unit 52.

As have already been described, the amplifying unit 52 functions as a comparator to output a digital signal in accordance with the waveform of the response signal RS as an output signal QC to the calculator 51. The calculator 51 of the sub control unit 50 calculates the vibration frequency VF of the response signal R8 based on the output signal QC, and sends it to the main control unit 40.

Upon acquiring of the vibration frequency VF, the main control unit 40 determines the ink amount of the target cartridge based on the vibration frequency VF (step S105). The main control unit 40 judges that the ink amount of the target cartridge is greater than, or at least equal to, a predetermined amount thereof when the vibration frequency VF is closer to the natural vibration frequency H1 described above (step S106). The main control unit 40 judges that the ink amount of the target cartridge is less than a predetermined amount thereof when the vibration frequency VF is closer to the natural vibration frequency H2 described above (step S107).

The main control unit 40 transmits the result of ink amount determination to the computer 90. By this means, the computer 90 is able to notify the result of the ink amount determination process to a user.

According to a printing system of the present embodiment of the invention, using the natural vibration frequency of a piezoelectric element in a target cartridge, it is possible to select one driving signal that excites the piezoelectric element effectively from among a plurality of driving signals that are outputted concurrently, and therefore to supply only the single selected driving signal. Thus, as the amplitude of residual vibration of the piezoelectric element is effectively increase, making it possible to improve the detection precision of a response signal, improving the precision the determination of ink amount.

In addition, according to another aspect of the present invention, it is possible to selectively supply a driving signal that effectively excites the vibration of a piezoelectric element with a simple system configuration, by separately providing a plurality of circuits for generating driving signals, each of which has a frequency different from the other/others, and by controlling the connection state of an analog switch that is connected to each circuit thereof.

Moreover, according to another aspect of the printing system of the invention, it is not necessary to rewrite the pulse waveform of a driving signal repeatedly, which resulting in a reduced processing load.

B. Exemplary Embodiment 2

According to the Exemplary Embodiment 1 described above, a driving signal generation circuit for generating the first driving signal and another driving signal generation circuit for generating the second driving signal are provided separately. In the second exemplary embodiment here, two types of driving signals are generated and supplied to a piezoelectric element by means of a single driving signal generation circuit.

B1. Printer Circuit Configuration

Figure 10:
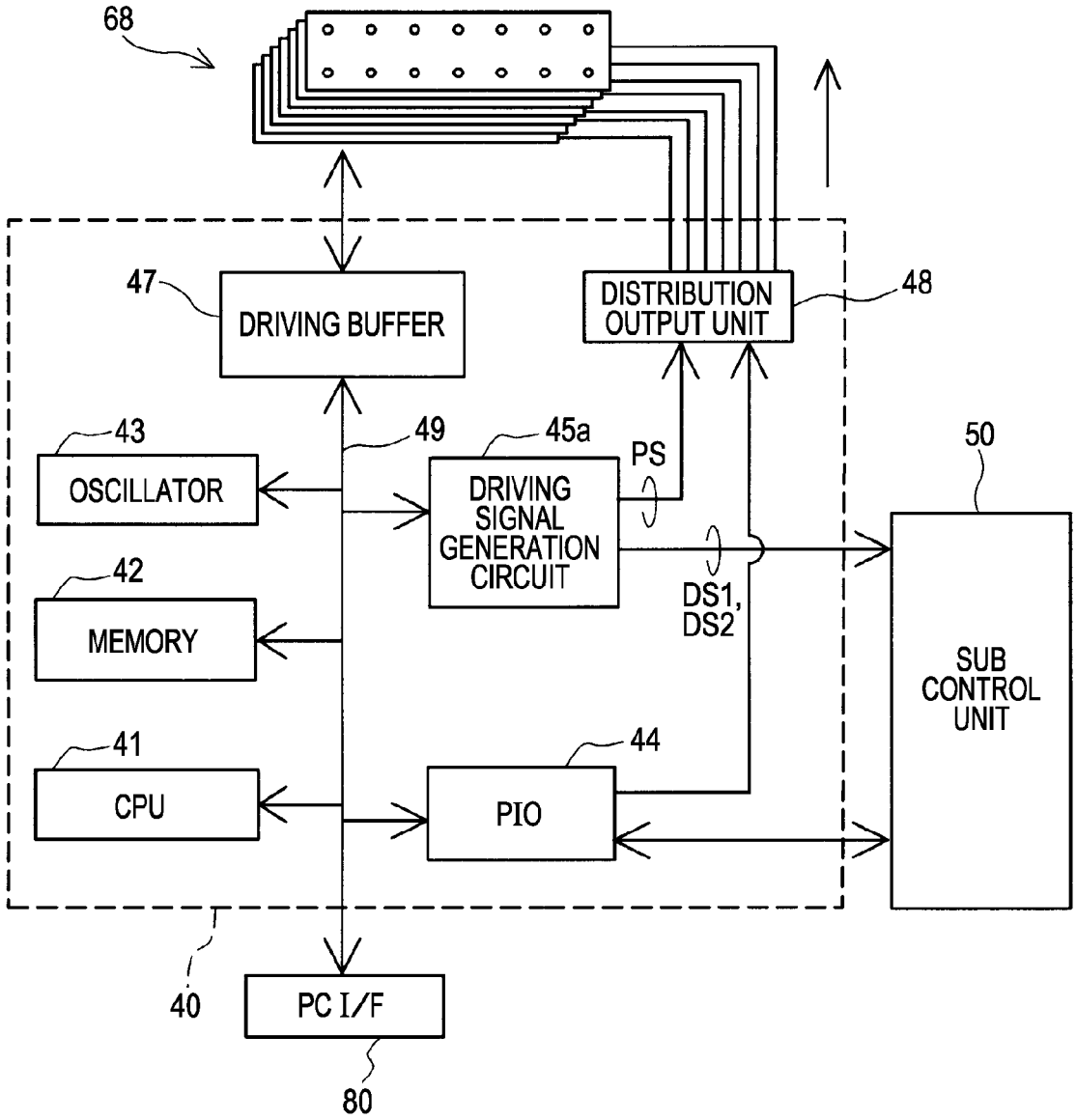
FIG. 10 is an explanatory drawing that schematically illustrates an exemplary electric configuration of a main control unit according to the second embodiment of the invention.
Figure 11:
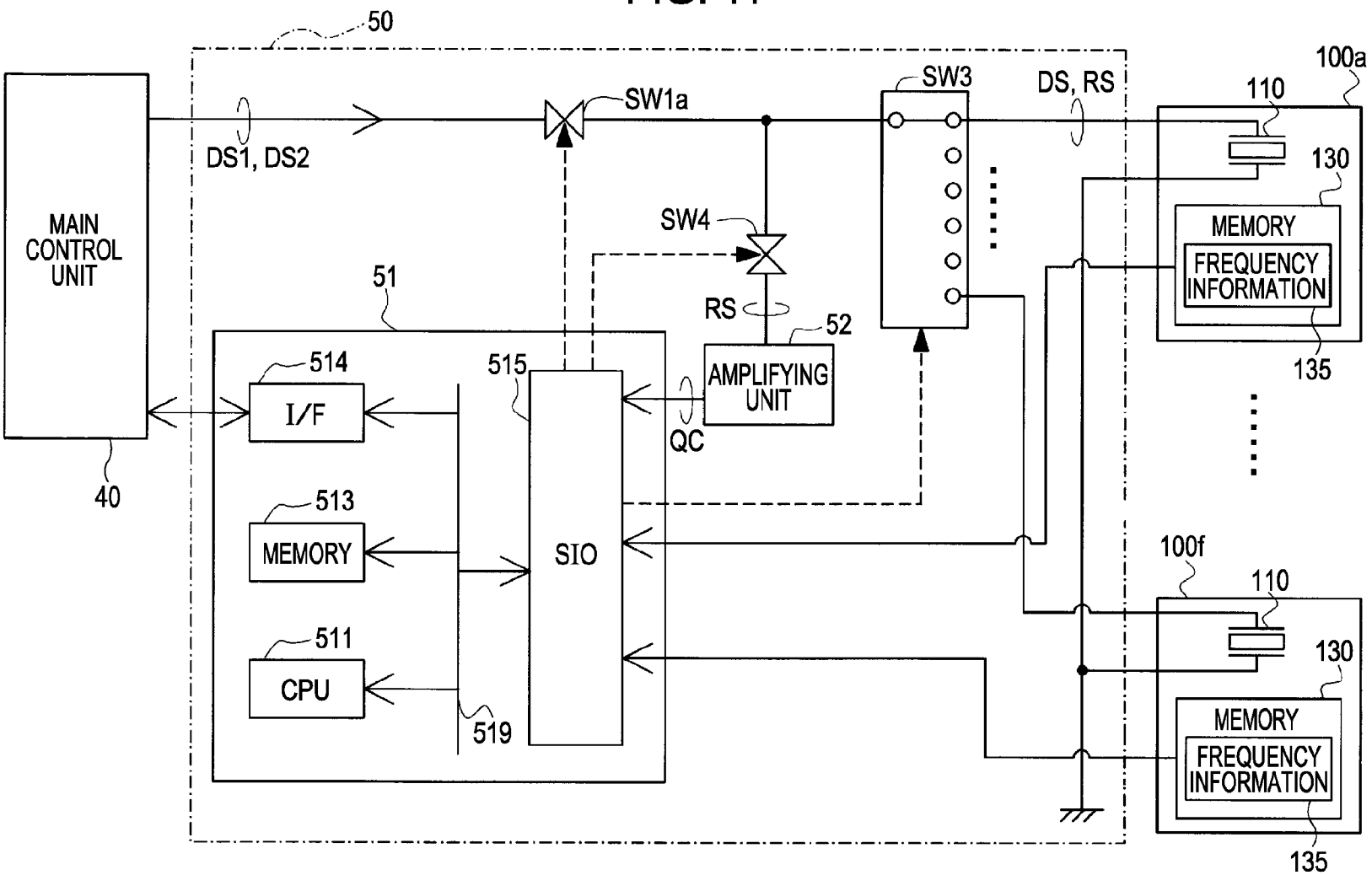
FIG. 11 is an explanatory drawing that schematically illustrates an exemplary electric configuration of a sub control unit and cartridges according to the second embodiment of the invention.

The circuit configuration of the printer 20 is explained with reference to FIG. 10 and FIG. 11. FIG. 10 illustrates the electric configuration of the main control unit 40 according to the second embodiment of the invention. FIG. 11 illustrates the electric configuration of the sub control unit 50 and the cartridges according to the second embodiment of the invention.

In the circuit configuration of the main control unit 40 according to the second embodiment is similar to the configuration described in the first embodiment, except as it relates to the driving signal generation circuit 45*a*. Here, the driving signal generation circuit 45*a* generates a head driving signal PS, which is supplied to the print head 69 via the distribution output unit 48, and a first sensor driving signal DS1 and a second sensor driving signal DS2, which are supplied to the piezoelectric element 112 of each of the cartridges 100*a*-100*f* via the sub control unit 50. In this embodiment, hereafter, a "driving signal" signifies a sensor driving signal. The driving signal generation circuit 45*a* supplies a driving signal that is selected by the CPU 41 out of the first driving signal DS1 and the second driving signal DS2 to the sensor 110 via the sub control unit 50.

The sub control unit 50 is a circuit that performs processing which is related to the cartridges 100*a*-100*f* in cooperation with the main control unit 40. Along with the processing related to the cartridges 100*a*-100*f*, FIG. 11 shows, in a selective manner, portions that are necessary for processing of determining the remaining amount of ink. An explanation on the sub control unit 50 configuration other than the first switch SW1*a* is omitted here because it is the same as that of the first exemplary embodiment.

The first switch SW1*a* is a 1-channel analog switch. One terminal of the first switch SW1*a* is connected to the driving signal generation circuit 45*a* of the main control unit 40, whereas the other terminal thereof is connected to the third switch SW3 and the fourth switch SW4. The first switch SW1*a* is set in an ON state when the first driving signal DS1 or the second driving signal DS2 is supplied to the sensor 110, whereas it is set in an OFF state when a response signal RS coming from the sensor 110 is detected.

Using the circuit configuration described above, the printer 20 generates and outputs a driving signal as explained below. The CPU 41 acquires the frequency information 135 that is stored in the memory 130 of the ink cartridge 100*a*; and based on the frequency information 135, the CPU 41 selects either one of the first driving signal DS1 and the second driving signal DS2 as a driving signal that should be supplied to the piezoelectric element 112 of the ink cartridge. In the memory 42 of the main control unit 40, a driving signal generation parameter (for example, a DAC value for each update cycle) for generating the first driving signal DS1 and the second driving signal DS2 has been stored in advance. The CPU 41 acquires the driving signal generation parameter for generating the selected driving signal DS from the memory 42, and gives instructions to the driving signal generation circuit 45*a* so that the driving signal generation circuit 45*a* generates and outputs the driving signal by using the acquired driving signal generation parameter. The driving signal generation circuit 45*a* generates and outputs the driving signal in accordance with the instructions given by the CPU 41. According to a printing system of the second embodiment of the invention described above, it is possible to generate two types of driving signals easily just by employing a single driving signal generation circuit.

Thus, without requiring the output of all of a plurality of driving signals, each having a frequency different from the other/others, it is possible to excite the residual vibration of a piezoelectric element in an effective manner, resulting in a reduced processing load.

C. Variations

Although a head driving signal PS is generated by means of the first driving signal generation circuit 45 in the first exemplary embodiment described above, as an alternative approach, for example, more than one type of head driving signal may be generated by using both the first driving signal generation circuit 45 and the second driving signal generation circuit 46. In such a variation, it may be configured that the generation the head driving signals are performed in a parallel manner by the first driving generation circuit and the second driving signal generation circuit, and that the head driving signals are supplied to the head in a parallel manner, and that a head driving signal is selected by means of a dot ON/OFF signal supplied from the driving buffer 47 such that the selected head driving signal is applied to the head 44 for image printing. In this variation, the execution of print operation by means of more than one type of head driving signals makes it possible to discharge various sizes of ink drops in accordance with the types of the head driving signals, making it further possible to increase the gradation level/the number of grayscales of a print image, bringing about the improvement in the quality of the print image thanks to the enhanced gradation level/grayscales. On the other hand, during sensor operation, the generation of more than one type of sensor driving signals by means of both the first driving signal generation circuit 45 and the second driving signal generation circuit 46 makes it possible to detect the amount of ink by means of a sensor driving signal that is in accordance with the natural vibration frequency of the piezoelectric element on the sensor of the ink cartridge. With effective utilization of a plurality of driving signal generation circuits during each of the print operation and inspection operation, it is possible to improve both image quality and accuracy of the ink amount detection process.

(2) Although the natural vibration frequency fE in an ink-absent state of an piezoelectric element is stored as the frequency information 135 in the exemplary embodiments described above, in an variation of the invention, the natural vibration frequency fF in an ink-present state may be stored. In addition, information indicating either one of the first driving signal or the second driving signal may be contained in the frequency information 135.

(3) Although it is assumed in the exemplary embodiments described above, two types of driving signals, one of which has a frequency different from the frequency of the other, are outputted concurrently, as an example of variations of the invention, three or more types of driving signals having frequencies that vary from one to another may be outputted concurrently. It is possible to implement such an operation just with a simple system configuration by increasing the number of driving signal generation circuits provided therein.

(4) Although it is assumed in the exemplary embodiments described above that a set of the first driving signal and the second driving signal are outputted concurrently, as an example of variations of the invention, the first driving signal and the second driving signal may be outputted sequentially.

(5) Although it is assumed in the first exemplary embodiment described above that both of the first driving signal and the second driving signal are outputted, as an example of variations of the invention, one driving signal only may be outputted. The one driving signal may be selected based on the frequency information where two driving signal generation circuits (the first driving signal generation circuit 45 and the second driving signal generation circuit 46) are provided in a system. It is possible to implement such an operation just with a simple system configuration by giving instructions for generating and outputting a driving signal only to a driving signal generation circuit that generates the selected driving signal.

Although various exemplary embodiments of the present invention are described above, needless to say, the invention is in no case restricted to these exemplary embodiments described herein; the invention may be configured in a variety of variations without departing from the spirit thereof.

What is claimed is:

1. A printing apparatus to which a printing material container is detachably mounted, the printing material container having a piezoelectric element and a memory unit storing frequency information on natural vibration frequency of the piezoelectric element, the printing apparatus comprising:

means for acquiring the frequency information from the memory unit;

means for selectively supplying either a first driving signal having a first frequency or a second driving signal, having a second frequency different from the first frequency, to the piezoelectric element;

means for detecting a response signal outputted in response to vibration of the piezoelectric element;

means for measuring the vibration frequency of the piezoelectric element contained in the response signal; and means for determining whether an amount of printing material in the printing material container is more than a predetermined value based on the vibration frequency.

2. The printing apparatus according to claim 1, wherein the means for selectively supplying comprises a first driving signal generation section generating the first driving signal, a second driving signal generation section generating the second driving signal, and a supply controlling section selecting a driving signal from the first driving signal and the second driving signal and supplying the selected driving signal to the piezoelectric element.

3. The printing apparatus according to claim 2, wherein the printing material container comprises a first terminal capable of electrically connecting to the printing apparatus, the printing apparatus further comprising a second terminal capable of connecting to the first terminal, the means for selectively supplying further comprising a first connecting section and a second connecting section, the first connecting section being capable of electrically connecting the first driving signal generation section to the second terminal and the second connecting section being capable of electrically connecting the second driving signal generation section to the second terminal, and the supply controlling section is capable of setting either the first connecting section or the second connecting section in a connection state and the other in a disconnection state based on the selected driving signal.

4. The printing apparatus according to claim 3, further comprising an output controlling section capable of outputting the first driving signal and the second driving signal concurrently.

5. The printing apparatus according to claim 3, wherein the supply controlling section is capable of controlling the connection of the first connecting section and the second connecting section prior to the outputting of the first driving signal and the second driving signal.

6. The printing apparatus according to claim 1, wherein the means for selectively supplying supplies a first driving signal within a range between the minimum value and the middle value of a possible frequency range of the vibration frequency of the piezoelectric element when a predetermined amount, or greater, of the printing material is present in the printing material container, and supplies a second driving signal when the natural vibration frequency specified by the frequency information falls within a range between the middle value and the maximum value in a possible frequency range of the vibration frequency of the piezoelectric element.

7. A method for determining the amount of a printing material, which is implemented by a printing apparatus to which a printing material container is detachably mounted, the printing material container having a piezoelectric element and a memory in which frequency information on natural vibration frequency of the piezoelectric element is stored, the method comprising:

acquiring the frequency information from the memory;

selecting from a first driving signal having a first frequency and a second driving signal having a second frequency which is different from the first frequency, and supplying the selected driving signal to the piezoelectric element;

detecting a response signal that is outputted in response to the vibration of the piezoelectric element;

measuring vibration frequency of the piezoelectric element in the response signal; and determining whether an amount of printing material in the printing material container is more than a predetermined value based on the measured vibration frequency.

8. A printing apparatus comprising:

a printing material container which is detachably mounted to the printing apparatus, the printing material container having a piezoelectric element and a memory unit storing frequency information on natural vibration frequency of the piezoelectric element;

means for acquiring the frequency information from the memory unit;

means for generating a first driving signal;

means for generating a second driving signal;

means for selectively supplying to the piezoelectric element a first driving signal within a range between the minimum value and the middle value of a possible frequency range of the vibration frequency of the piezoelectric element when a predetermined amount, or greater, of the printing material is present in the printing material container, and a second driving signal when the natural vibration frequency specified by the frequency information falls within a range between the middle value and the maximum value in a possible frequency range of the vibration frequency of the piezoelectric element;

means for detecting a response signal outputted in response to vibration of the piezoelectric element;

means for measuring the vibration frequency of the piezoelectric element contained in the response signal; and means for determining the amount of printing material contained in the printing material container based on the vibration frequency.

9. The printing apparatus according to claim 8, wherein the printing material container comprises a first terminal capable of electrically connecting to the printing apparatus, the printing apparatus further comprising a second terminal capable of connecting to the first terminal, the means for selectively supplying comprising a first connecting section and a second connecting section, the first connecting section electrically connecting the means for generating the first driving signal to the second terminal and the second connecting section electrically connecting the means for generating the second driving signal to the second terminal, and the means for selectively supplying setting either the first connecting section or the second connecting section in a connection state and the other in a disconnection state based on the selected driving signal.

10. The printing apparatus according to claim 9, further comprising an output controlling section capable of outputting the first driving signal and the second driving signal concurrently.

11. The printing apparatus according to claim 9, wherein the means for selectively supplying controls the connection of the first connecting section and the second connecting section prior to the outputting of the first driving signal and the second driving signal.

* * * * *